US006929195B2

(12) United States Patent
Park

(10) Patent No.: US 6,929,195 B2
(45) Date of Patent: Aug. 16, 2005

(54) FUEL INJECTOR HAVING A SWIRL REGULATOR

(75) Inventor: Jong-Bum Park, Ansan (KR)

(73) Assignee: Hyundai Motor Company, Seoul (KR)

( * ) Notice: Subject to any disclaimer, the term of this patent is extended or adjusted under 35 U.S.C. 154(b) by 345 days.

(21) Appl. No.: 10/126,420

(22) Filed: Apr. 18, 2002

(65) Prior Publication Data

US 2003/0075619 A1 Apr. 24, 2003

(30) Foreign Application Priority Data

Oct. 23, 2001 (KR) ..... 2001-0065252

(51) Int. Cl.[7] ..... B05B 1/34; F02M 39/00

(52) U.S. Cl. ..... 239/463; 239/461; 239/533.3; 239/585.1; 239/585.5

(58) Field of Search ..... 239/463, 461, 239/468, 469, 475, 483, 484, 88, 89, 91, 92, 533.2, 533.3, 533.9, 585.1, 585.3, 585.4, 585.5; 251/121.15, 121.21

(56) References Cited

U.S. PATENT DOCUMENTS 3,937,011 A * 2/1976 Caruel et al. ..... 60/737
4,015,571 A * 4/1977 Stumpp ..... 123/457
4,264,040 A * 4/1981 Saito ..... 239/585.1
4,827,883 A * 5/1989 Khalighi et al. ..... 123/308
4,869,429 A * 9/1989 Brooks et al. ..... 239/473
5,975,433 A 11/1999 Hasegawa et al.

FOREIGN PATENT DOCUMENTS

JP 2000314358 A 11/2000

* cited by examiner

*Primary Examiner*—Davis Hwu
(74) *Attorney, Agent, or Firm*—Morgan, Lewis & Bockius LLP

(57) ABSTRACT

A fuel injector is provided which comprises a swirl generator and a swirl regulator. The swirl regulator comprises an upper housing mounted to an upper part of said body and a lower housing including a center aperture, said lower housing and said upper housing cooperatively defining a plurality of cavities; a rotating member including a center shaft and a plurality of vanes formed thereon, said center shaft being rotatably disposed in said center aperture of said lower housing and coupled to said swirl generator, said vane being disposed in said cavity such that said cavity is divided into a first chamber and a second chamber, said first chamber communicating with said fuel passageway and said second chamber communicating with the outside of said injector; a biasing member forcing said rotating member to rotate against a force acting on said vane from a pressure difference between said fuel passageway and the outside of said injector.

21 Claims, 5 Drawing Sheets

FUEL INJECTOR HAVING A SWIRL REGULATOR

FIELD OF THE INVENTION

The present invention relates to a fuel injector, and more particularly, to a fuel injector including a swirl regulator for regulating an amount of swirl force imparted to injected fuel, using pressure within a fuel passageway.

BACKGROUND OF THE INVENTION

As shown in FIG. 1, a typical fuel injector 20 has a swirl generator 40 to impart a swirl force to injected fuel. The swirl generator 40 includes an inner member and an outer member that cooperatively define a plurality of fuel passageways and impart the swirl force to injected fuel. The outer member is fixed to a body of the fuel injector 20, and the inner member is rotatably inserted into a center hole of the outer member. A knob 60 is connected to the inner member, and thereby the inner member can be rotated by rotating the knob 60.

The fuel injector 20 includes a fuel inlet portion 12, a fuel outlet portion 14 and a fuel passageway 16.

If the inner member is rotated, the shape of the fuel passageways changes so that the amount of swirl force imparted to the injected fuel can be regulated.

In such a fuel injector, a rotator such as a motor is needed to rotate the knob. The rotator is disposed outside the fuel injector and is controlled by an electronic control unit (ECU). To control the fuel injector, the fuel injection timing, fuel injection duration, fuel pressure, and an axial position of the inner member need to be controlled. However, these parameters are not considered in general ECU control, and thus to control the fuel injector, the whole ECU control should be changed.

Further, because an intake manifold is disposed near the fuel injector, it is very difficult to dispose a motor proximate to the injector to control the axial position of the inner member. A recent tendency in the intake manifold is to widen its sectional area to minimize the loss of intake flow, and therefore it is much more difficult to secure a space for mounting the motor.

Furthermore, in a gasoline direct injection (GDI) engine, a valve for strengthening tumble or a valve for controlling the amount of swirl force is installed in the intake manifold for obtaining a strong intake flow at a low speed and a low load. Therefore, resistance force against intake air becomes larger than in a multi point injection (MPI) engine because the valve installed in the intake manifold disturbs air flow. For this reason, the sectional area of the intake manifold needs to be widened for better volume efficiency and better maximum torque output. Thus, available empty space near the intake manifold becomes much smaller.

In summary, it is difficult to secure space near the intake manifold and fuel injector for mounting means for regulating the amount of swirl force imparted to the injected fuel, and manufacturing cost becomes larger for an extra drive means and an extra ECU channel.

SUMMARY OF THE INVENTION

In a preferred embodiment of the present invention, a fuel injector includes a main body and a swirl regulator disposed in an upper part of the main body. The swirl regulator comprises upper and lower housings, a center shaft, a vane and a resilient member. The upper housing is mounted to the main body and the lower housing includes a center aperture. The center shaft is disposed in the aperture of the lower housing. The vane is supported by the center shaft, and is disposed between a lower part of the upper housing and an upper part of the said lower housing. The resilient member, preferably a spring, is connected to the center shaft such that the center shaft rotates according to fuel pressure.

In a further preferred embodiment, the fuel injector further comprises a body, a seat and a swirl generator and regulator. The body includes an inlet portion, an outlet portion, and a fuel passageway extending from the inlet portion to the outlet portion. The seat is secured in the fuel passageway proximate to the outlet portion. The seat also defines a center aperture. The swirl generator is rotatably disposed in the center aperture of the seat and a plurality of fuel channels are formed between the seat and the swirl generator. The swirl regulator rotates the swirl generator such that the swirl component imparted to injected fuel is regulated. Preferably, the swirl regulator comprises an upper housing mounted to an upper part of the body and a lower housing including a center aperture. The lower housing and the upper housing cooperatively define a plurality of cavities. In addition, a rotating member is formed with a center shaft and a plurality of vanes thereon. The center shaft is rotatably disposed in the center aperture of the lower housing and coupled to the swirl generator. The vanes are disposed in the cavity such that the cavity is divided into at least a first chamber and a second chamber. The first chamber communicates with the fuel passageway and the second chamber communicates with the outside of the injector. A biasing member forces the rotating member to rotate against a force acting on the vane by a pressure difference between the fuel passageway and the outside of the injector.

Preferably, the first chamber communicates with the fuel passageway through a first opening, formed in the lower housing, and the second chamber communicates with the outside of the injector through a second opening, formed in the upper housing. More preferably, the rotating member further comprises a circular head, with the vane mounted on the circular head. The rotating member further comprises a stopper disposed on each side of the vane, and one end of the biasing member is secured to the lower housing and the other end of the biasing member is secured to the circular head. The biasing member is preferably a coil spring with the center shaft of the rotating member passing through the coil spring.

It is preferable that the swirl regulator further comprises a cover coupled to the upper housing. The cover has a fitting member for connection with the body.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

DETAILED DESCRIPTION OF THE PREFERRED EMBODIMENTS

Hereinafter, a preferred embodiment of the present invention will be described in detail with reference to the accompanying drawings.

Figure 1:
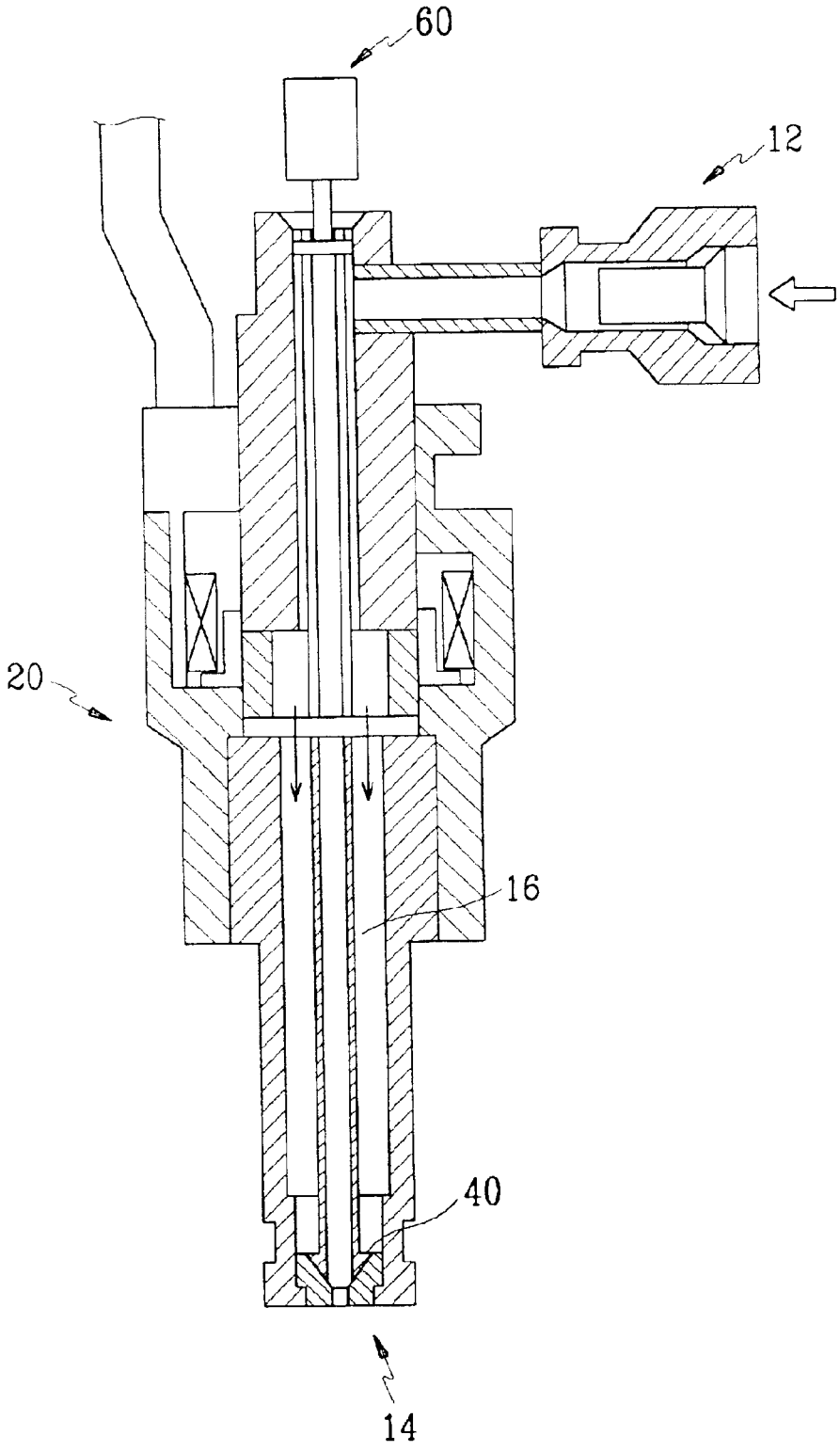
FIG. 1 (Prior Art)
FIG. 1 is a cross-sectional view of the fuel injector of the prior art along its longitudinal axis.
Figure 2:
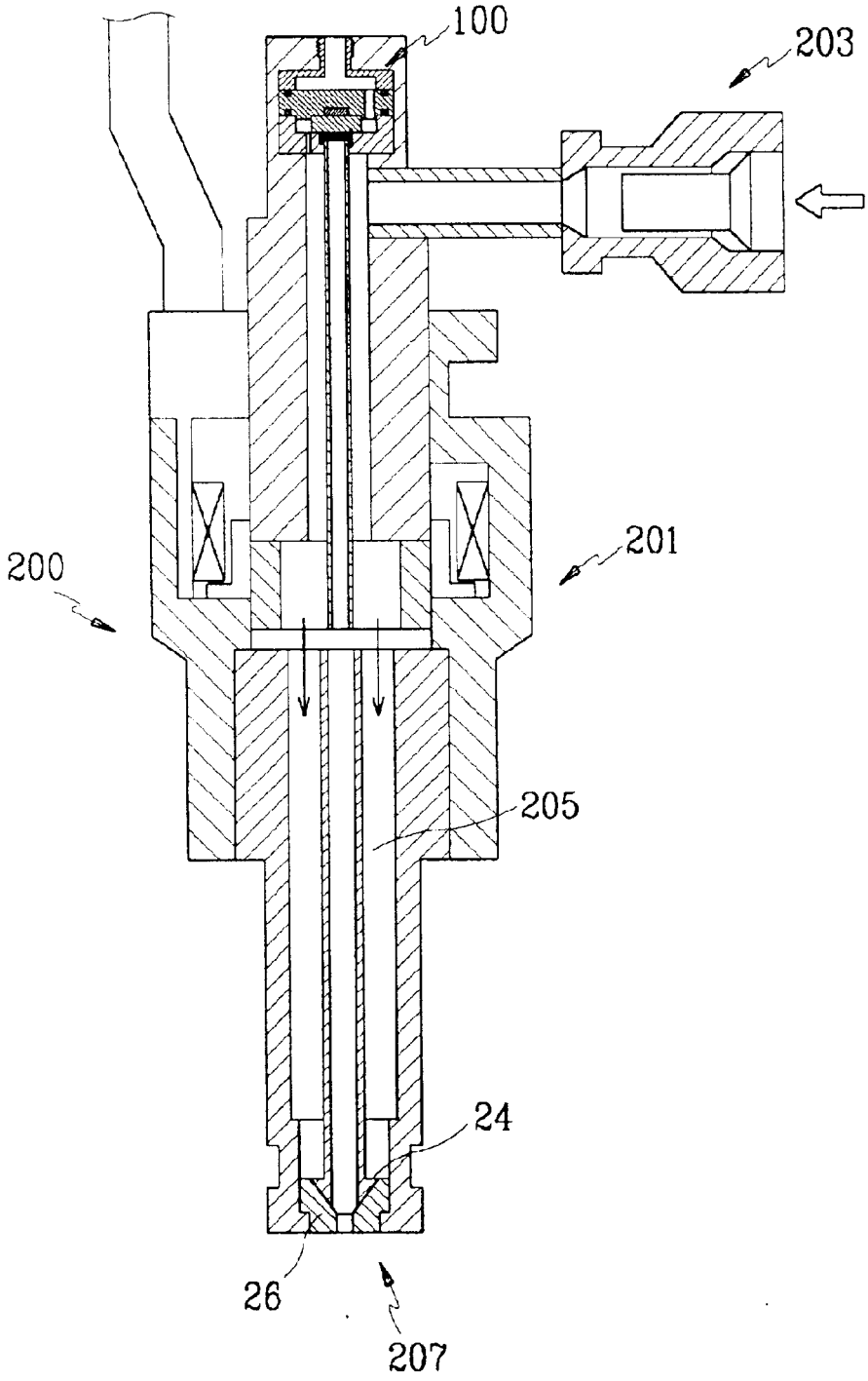
FIG. 2 is a cross-sectional view of the fuel injector according to a preferred embodiment of the present invention along its longitudinal axis.

As shown in FIG. 2, a fuel injector 200 according to the preferred embodiment of the present invention comprises a body 201 including an inlet portion 203, an outlet portion 207, and a fuel passageway 205 extending from the inlet portion 203 to the outlet portion 207 substantially along a longitudinal axis.

A seat 26 is coupled to the body 201 of the fuel injector 200 at an end portion of the fuel passageway 205, the seat 26 being provided with a center aperture. Swirl generator 24 is rotatably inserted into the center aperture of the seat 26. A plurality of fuel channels are formed between the seat 26 and the swirl generator 24. While passing through the fuel channel, the fuel is imparted with a swirl component. By rotating swirl generator 24, the magnitude of the swirl component may be changed.

A swirl regulator 100 according to a preferred embodiment of the present invention is a device that rotates the swirl generator 24 so as to regulate the amount of swirl component. As shown in FIG. 2, the swirl regulator 100 is preferably mounted to an upper portion of the body 201 of the fuel injector 200.

Figure 3:
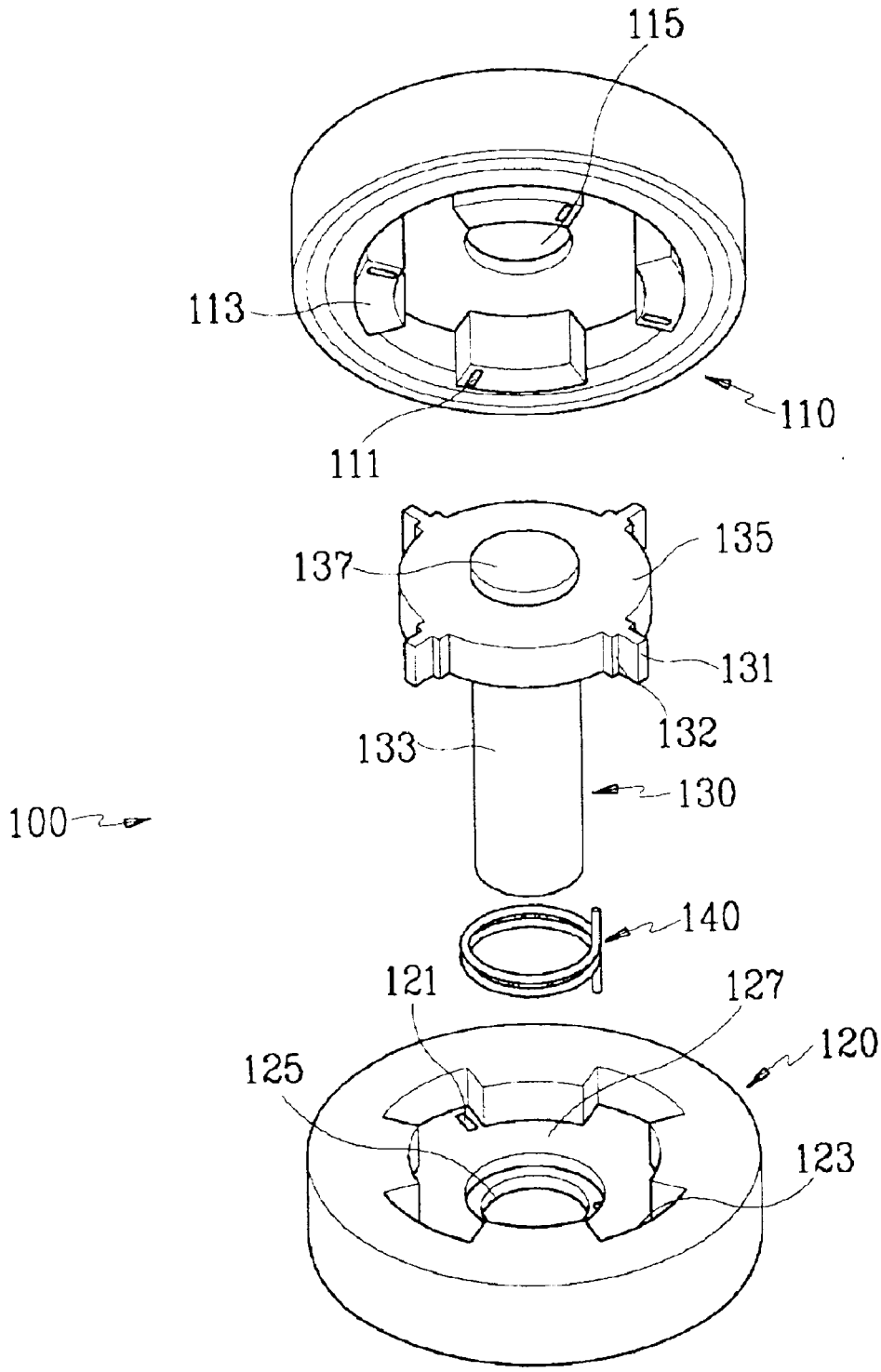
FIG. 3 is an exploded perspective view of the swirl regulator adapted to the fuel injector according to the preferred embodiment of the present invention.
Figure 4:
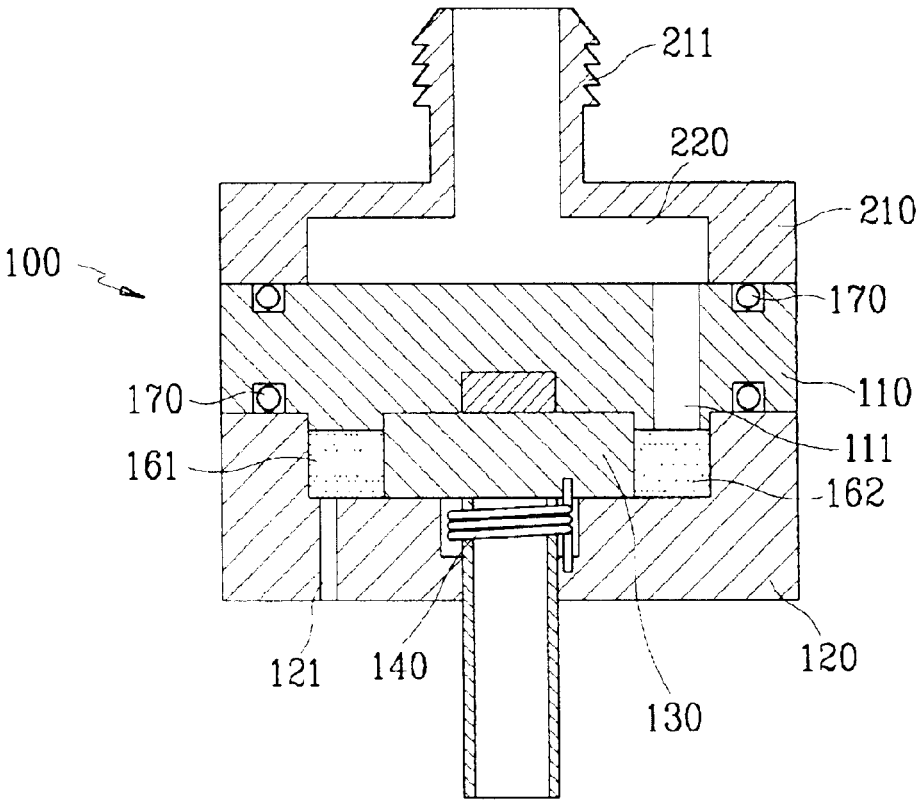
FIG. 4 is an enlarged sectional view of the swirl regulator of FIG. 3.

FIGS. 3 and 4 illustrate the swirl regulator 100 in detail. Referring to the drawings, the swirl regulator 100 includes an upper housing 110, a lower housing 120 coupled to the upper housing 110, a rotating member 130 disposed between the upper housing 110 and the lower housing 120, and a bias member such as torsion spring 140.

The upper housing 110 is provided with a plurality of blocks 113, and in each block 113 a second opening 111 is perforated. In a preferred embodiment of the present invention, there are four blocks. However, the number of blocks is not restricted to four. The second opening 111 communicates with the outside of the fuel injector 10.

The lower housing 120 includes a circular groove 127, and a plurality of fan-shaped grooves 123 are formed along a circumference of the groove 127. The number of grooves 123 is equal to the number of blocks 113, and the positions of the grooves 123 correspond to the positions of the blocks 113. A center aperture 125 is formed at the center of the circular groove 127.

A first opening 121 is perforated in the lower housing 120, which communicates with the fuel passageway 205 as shown in FIG. 2.

If the lower housing 120 is coupled to the upper housing 110, four cavities are formed between the blocks 113 of the upper housing 110 and the grooves 123 of the lower housing 120.

The rotating member 130 includes a downwardly extending center shaft 133, a circular head 135 that is coupled near the top of the center shaft 133, and four vanes 131 integrally formed on the head 135. The head 135 is located in the groove 127 of the lower housing 120, and the center shaft 133 is inserted into the aperture 125 of the lower housing 120. The center shaft 133 is connected to the swirl generator24.

With the upper housing 110, the lower housing 120 and the rotating member 130 joined together as stated above, four separate cavities are formed therebetween. The vanes 131 are respectively disposed in each cavity so that each cavity is divided into two chambers 161 and 162.

The first chamber 161 communicates with the fuel passageway 205 through a first opening 121 that is formed in the lower housing 120, and the second chamber 162 communicates with the outside of the fuel injector 200 through a second opening 111 that is formed in the upper housing 110.

When the fuel passageway 205 is filled with highly pressurized fuel, the pressure in the first chamber 161 becomes larger than that in the second chamber 162. A pressure difference between the two chambers 161 and 162 causes the rotating member 130 to rotate.

The coil spring 140 is disposed between the rotating member 130 and the lower housing 120. One end of the coil spring 140 is connected to the head 135 of the rotating member 130, and the other end of the coil spring 140 is connected to the lower housing 120. The coil spring 140 provides a rotational force to the rotating member 130.

A spring coefficient of the coil spring 140 is determined considering a maximum fuel pressure and a minimum fuel pressure. Thus, a desirable amount of swirl can be obtained under each particular fuel pressure.

The coil spring 140 is arranged such that the rotational force of the coil spring 140 opposes the rotational force caused by the pressure difference between the first chamber 161 and the second chamber 162.

The rotating member 130 further comprises a plurality of stoppers 132 that are coupled on each side of the vane 131 for preventing the vane 131 from blocking the first or second openings. A cylindrical projection 137 is formed on the top of the head 135 of the rotating member 130, and a cylindrical indent 115 is formed in the upper housing 110. The cylindrical projection 137 is rotatably inserted into the cylindrical indent 115 such that the rotating member 130 stably rotates. A circular sealing ring 170 is disposed between the upper housing 110 and the lower housing 120 for sealing.

The swirl regulator 100 further comprises a cover 210 coupled to the top of the upper housing 110. A cavity 220 is formed between the upper housing 110 and the cover 210. The cavity 220 communicates with the second chamber 162 through the second opening 111, and the outside of the fuel injector 10. The cover 210 includes a fitting member, such as one with threads 211, for connection with the body 201 of the fuel injector 200.

To prevent the swirl regulator 100 from rotating, a projection (not shown) is provided in a circumferential surface of the swirl regulator 100, the projection being coupled to a groove (not shown) formed in the body of the injector.

Figure 5:
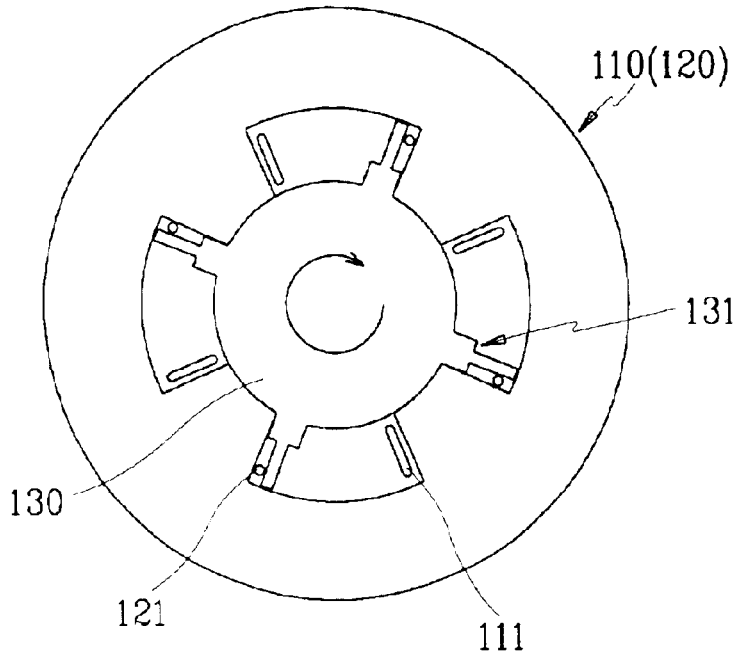
FIGS. 5 and 6 schematically show operating states of the swirl regulator of FIG. 3.
Figure 6:
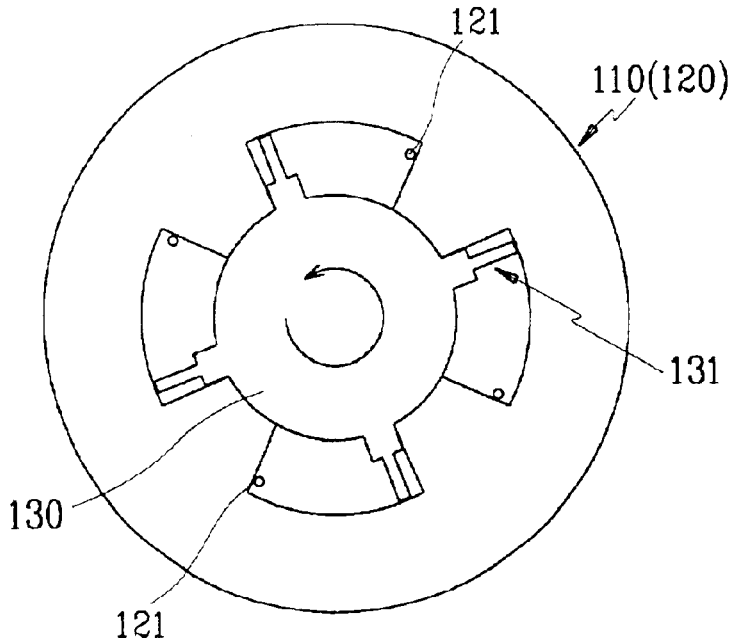

Referring to FIGS. 5 and 6, the function of swirl regulator 100 is explained. The swirl regulator 100 according to the preferred embodiment of the present invention regulates the swirl component of the injected fuel on the basis of the injected fuel pressure.

FIG. 5 shows a state such that the rotating member 130 has been rotated in a clockwise direction to a maximum position when the pressure of the injected fuel is relatively low, and FIG. 6 shows a state such that the rotating member 130 has been rotated in a counter-clockwise direction to a maximum position when the pressure of the injected fuel is relatively high.

If the rotating force of the pressure of the injected fuel is greater than the rotating force of the coil spring, the rotating member 130 rotates in the counter-clockwise direction. On the other hand, if the rotating force of the pressure of the injected fuel is smaller than the rotating force of the coil spring, the rotating member 130 rotates in the clockwise direction. If the rotating member 130 rotates according to change in the pressure of the injected fuel, the swirl generator 24 also rotates so that the swirl component of the injected fuel can be automatically changed.

The fuel injector according to the present invention can improve swirl characteristics, and therefore an engine can be operated under optimal conditions. Further, without an extra ECU control line and an extra swirl controller, the amount of the swirl component can be regulated, and thereby structure of an engine becomes simple and maintainability of an engine can be increased. Although preferred embodiments of the present invention have been described in detail hereinabove, it should be clearly understood that many variations and/or modifications of the basic inventive concepts herein taught which may appear to those skilled in the present art will still fall within the sprit and scope of the present invention, as defined in the appended claims.

What is claimed is:

1. A fuel injector comprising:

a main body having a fuel input and a fuel output and defining a fuel passageway between said fuel input and said fuel output;

a swirl generator associated with said fuel output to generate fuel swirl;

a swirl regulator to operate the swirl generator, wherein the swirl regulator includes an upper housing that is mounted to said main body;

a lower housing including a center aperture;

a center shaft rotatably disposed in the center aperature and connected to the swirl generator, wherein said upper housing, said lower housing, and said center shaft cooperatively define a plurality of cavities communicating with said fuel passageway;

a plurality of vanes coupled to the center shaft and disposed within said cavities and being rotatable in response to fuel pressure in said fuel passageway acting on said vanes; and a biasing member acting on said center shaft in opposition to the fuel pressure.

2. The fuel injector of claim 1, wherein a high pressure area and a low pressure area are formed in a space between said upper housing and said lower housing, said upper housing being provided with a second opening communicating with said low pressure area, said lower housing being provided with a first opening communicating with said high pressure area.

3. The fuel injector of claim 2, further comprising a cover coupled on top of said upper housing such that a space is formed between said cover and said upper housing, said space communicating with the outside of said fuel injector, said cover being provided with a fitting member for connecting said swirl regulator to said main body.

4. The fuel injector of claim 2, further comprising a stopper disposed on each side of said vane for preventing said vane from blocking said fuel hole or said return hole.

5. The fuel injector of claim 1, further comprising a circular sealing ring disposed between said upper housing and said lower housing for sealing.

6. A fuel injector comprising:

a body including an inlet portion, an outlet portion, and a fuel passageway extending from said inlet portion to said outlet portion;

a seat secured in said fuel passageway proximate to said outlet portion, said seat including a center aperture;

a swirl generator rotatably disposed in said center aperture of said seat, a plurality of fuel channels being formed between said seat and said swirl generator; and a swirl regulator for rotating said swirl generator in response to pressure of injected fuel such that an amount of swirl component imparted to injected fuel is regulated.

7. The fuel injector of claim 6, wherein said swirl regulator comprises:

an upper housing mounted to an upper part of said body;

a lower housing including a center aperture, said lower housing and said upper housing cooperatively defining a plurality of cavities;

a rotating member including a center shaft and a plurality of vanes formed thereon, said center shaft being rotatably disposed in said center aperture of said lower housing and coupled to said swirl generator, said vane being disposed in said cavity such that said cavity is divided into a first chamber and a second chamber, said first chamber communicating with said fuel passageway and said second chamber communicating with the outside of said injector; and a biasing member forcing said rotating member to rotate against a force acting on said vane from a pressure difference between said fuel passageway and the outside of said injector.

8. The fuel injector of claim 7, wherein said first chamber communicates with said fuel passageway through a first opening, formed in said lower housing.

9. The fuel injector of claim 7, wherein said second chamber communicates with the outside of said injector through a second opening, formed in said upper housing.

10. The fuel injector of claim 7, wherein said rotating member further comprises a circular head, said vane being mounted on said circular head.

11. The fuel injector of claim 10, wherein said rotating member further comprises a stopper being disposed on each side of said vane.

12. The fuel injector of claim 10, wherein one end of said biasing member is secured to said lower housing and the other end of said biasing member is secured to said circular head.

13. The fuel injector of claim 10, wherein said biasing member is a coil spring, said center shaft of said rotating member passing through said coil spring.

14. The fuel injector of claim 10, wherein said circular head includes a cylindrical projection at an upper surface thereof, and said upper housing includes a cylindrical indent into which said cylindrical projection is rotatably inserted.

15. The fuel injector of claim 7, wherein said swirl regulator further comprises a circular sealing ring disposed between said upper housing and said lower housing.

16. The fuel injector of claim 7, wherein said swirl regulator further comprises a cover coupled to said upper housing, said cover including a fitting member for a connection with said body.

17. The fuel injector of claim 16, wherein said fitting member comprises threads.

18. The fuel injector of claim 16, wherein said swirl regulator further comprises a circular sealing ring disposed between said cover and said upper housing.

19. A fuel injector, comprising:

a body member having a fuel input and a fuel output and defining a fuel passageway between said input and output;

a rotatable fuel swirl generator associated with said fuel output;

a regulator chamber communicating with said fuel passageway; and a rotatable vane structure disposed in said regulator chamber, said vane structure being rotatable in response to fuel pressure in said fuel passageway acting on said vane structure through said communication between said regulator chamber and fuel passageway, wherein said rotatable vane structure cooperates with said rotatable fuel swirl generator to change the fuel swirl in response to fuel pressure in said fuel pressure passageway.

20. The fuel injector according to claim 19, further comprising a biasing member acting on said rotatable vane structure in opposition to the fuel pressure.

21. The fuel injector according to claim 19, further comprising a shaft member extending between said vane structure and said swirl generator through which rotational forces are transmitted in response to the fuel pressure in the fuel passageway.

* * * * *